US005987777A

United States Patent [19]

Goebel et al.

[11] Patent Number: 5,987,777

[45] Date of Patent: Nov. 23, 1999

[54] DRY END

[75] Inventors: Werner Goebel, Lauingen; Karlheinz Straub, Heidenheim, both of Germany

[73] Assignee: Voith Sulzer Papiermaschinen GmbH, Germany

[21] Appl. No.: 09/091,715

[22] PCT Filed: Dec. 21, 1996

[86] PCT No.: PCT/EP96/05798

§ 371 Date: Sep. 9, 1998

§ 102(e) Date: Sep. 9, 1998

[87] PCT Pub. No.: WO97/23690

PCT Pub. Date: Jul. 3, 1997

[30] Foreign Application Priority Data

Dec. 22, 1995 [DE] Germany ..... 195 48 303

[51] Int. Cl.[6] ..... F26B 3/00; D21F 5/00

[52] U.S. Cl. ..... 34/448; 34/455; 34/461; 34/465; 34/114; 34/117; 34/120

[58] Field of Search ..... 34/445, 448, 454, 34/455, 461, 463, 464, 465, 114, 117, 119, 120, 122, 123, 611, 629, 633, 638, 642; 162/206, 207, 208, 209

[56] References Cited

U.S. PATENT DOCUMENTS 4,986,009 1/1991 Haessner et al. ..... 34/458
5,337,490 8/1994 Griffin et al. .
5,477,624 12/1995 Haessner et al. ..... 34/117
5,600,897 2/1997 Sollinger et al. ..... 34/117 X
5,718,058 2/1998 Atzinger ..... 34/117
5,735,060 4/1998 Atzinger et al. ..... 34/117

FOREIGN PATENT DOCUMENTS 0479748 4/1992 European Pat. Off. .
3941242 6/1991 Germany .

*Primary Examiner*—Henry Bennett
*Assistant Examiner*—Steve Gravini
*Attorney, Agent, or Firm*—Ostrolenk, Faber, Gerb & Soffen, LLP

[57] ABSTRACT

The invention relates to a dry end for drying a material web, in particular a paper or cardboard web, having at least one drying group with a plurality of drying cylinders and web guiding rollers and at least one nozzle device for transporting the threading part of the material web along a winding path by means of at least one conveyor band. The dry end is characterised in that groups of at least two nozzle devices (17, 19, 21) located at the same side of the material web (11) follow each other in the direction of transport of the material web (11).

44 Claims, 3 Drawing Sheets

DRY END

DESCRIPTION

The invention relates to a dry end for drying a material web, in particular a paper or cardboard web in a paper machine.

BACKGROUND OF THE INVENTION

Dry ends and methods of the type in question here are known DE 39 41 242 A1. At the start of the manufacture of a material web, for example on a paper manufacturing machine, the material web emerging from a press is firstly diverted into a spoil collection area upstream of the first dry end or drying group adjoining the press. It is also conceivable to direct the material web from the press as far as the first dry cylinder of the dry group adjoining the press and to divert it on from there into a spoil collection area. In order to thread the material web through the dry end, a threading strip which is also referred to as a band is cut off from the leader edge of the material web in the longitudinal direction (running direction of the machine) and that edge is threaded through the dry end, preferably at full working speed of the paper manufacturing machine, without displacing it sideways. For this purpose, the threading strip must run through the dry cylinder and web guiding rollers of the dry end along a winding path. For this reason, it is necessary to guide and to stabilize this strip so that it does not become wound around the dry cylinder, which would cause the threading procedure to be interrupted. The known dry end has nozzle devices, for example compressed air pipes which extend at least over the width of the threading strip and serve to pick off said strip from a dry cylinder and transfer it to the following web guiding roller viewed in the conveying direction of the material web. It has become apparent that the transfer of the threading strip does not take place reliably in all cases, with the result that a threading procedure frequently has to be aborted and repeated, and it becomes necessary to clean the dry end.

SUMMARY OF THE INVENTION

For this reason, an object of the invention is to provide a dry end which is distinguished by improved threading characteristics.

In order to achieve this object, a dry end is proposed which is distinguished by the fact that at least one/two nozzle devices are arranged one behind the other for transferring a threading strip from a dry cylinder to a following web guiding roller, said nozzle devices applying a stream of gas to the same side of the material web. Such a dry end is distinguished by simple design and by reliable threading characteristics.

An embodiment of the dry end is preferred in which the nozzle devices are mounted on a scraper which interacts, for example, with a dry cylinder and is arranged directly in the transfer region between a dry cylinder and an adjacent web guiding roller which is preferably acted on by vacuum. The airstream generated by the nozzle devices can thus act directly on the material web which is located in the region of the free running section between the dry cylinder and the web guiding roller.

A further preferred embodiment of the dry end which is distinguished by the fact that the nozzle devices emit a gas stream with defined flow direction. The various nozzle devices or their gas streams are directed in such a way that, on the one hand, the material web is reliably released from the dry cylinder, that said web is, on the other hand, reliably applied to the web guiding roller and, finally, that it can be transferred from the web guiding roller (with vacuum support) to the next dry cylinder.

In particular, an embodiment of the dry end which is distinguished by the fact that the nozzle devices have individual nozzles or slit nozzles is preferred. The use of individual nozzles makes it possible to apply to the material web a strong, directional air stream which brings about, for example, reliable release of the material web from the dry cylinder. The use of slit nozzles leads to stabilization of the threading strip so that during the threading operation the latter cannot become twisted, which would lead to disruption of the operation of the machine for manufacturing a material web.

The object of the invention is also to provide a method with which a threading strip can reliably be guided through a dry end.

In order to achieve this object, a method is proposed which is distinguished by the fact that during the transfer from a dry cylinder to a web guiding roller the material web has at least two/one gas streams applied to it, ensuring that the transfer of the threading strip from a dry cylinder to a following web guiding roller is particularly reliable and resistant to faults.

One preferred embodiment of the method is distinguished by the fact that the gas streams within a dry end are activated with staggered timing. It is therefore possible to adapt the activation of the gas streams to the running of a threading strip within the dry end and thus to reduce significantly the energy necessary to generate the gas stream.

One embodiment of the method is particularly preferred which is distinguished by the fact that the gas streams are generated by means of a clocked air stream. The clocking has the result, on the one hand, that the material web is reliably released from a dry cylinder as a result of high-energy pulses, and on the other hand causes the quantity of air required to generate the gas streams to be significantly reduced.

BRIEF DESCRIPTION OF THE DRAWINGS

The invention is explained in more detail below with reference to the drawing, in which.

DESCRIPTION OF A PREFERRED EMBODIMENT

Figure 1:
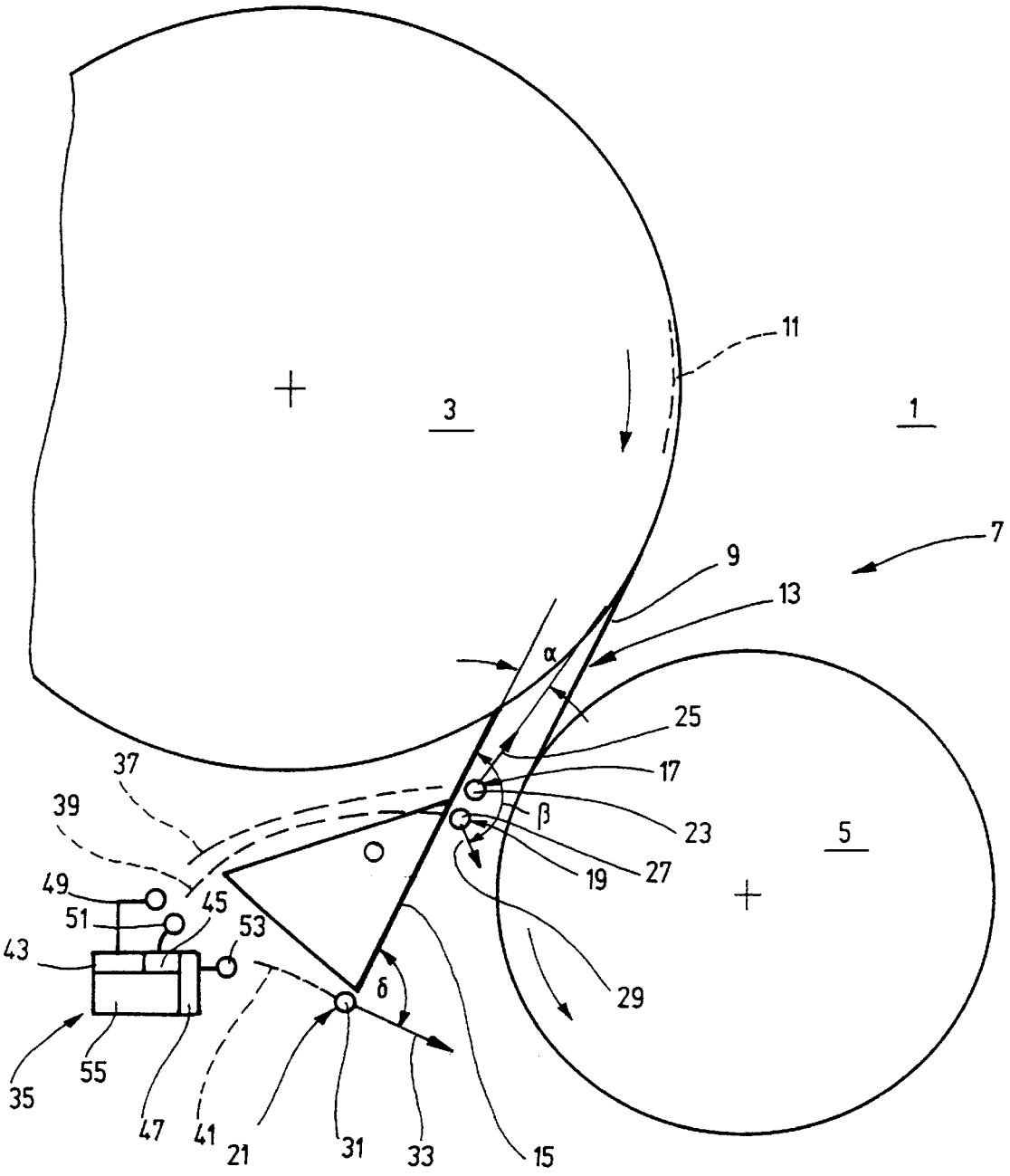
FIG. 1 shows a schematic side view of part of a dry end.

The dry end described below can generally be used for machines for manufacturing material webs. It is particularly suitable for machines for manufacturing paper webs and cardboard webs. It is assumed below that the drawing represents parts of a paper manufacturing machine.

FIG. 1 shows in a highly schematic side view of part of a dry end 1, namely a dry cylinder 3 and a web guiding roller 5 of a dry group 7. A conveyor belt 9 which is also referred to as a dry sieve is led in a partially wrapped fashion in a winding path around the dry cylinder 3 and the web guiding roller 5. Here, a material web 11 which is indicated here only by dashed lines and which is arranged on the outside in the region of the web guiding roller 5 lies between the surface of the dry cylinder 3 and the conveyor belt 9.

Between the dry cylinder 3, which rotates here in the clockwise direction, as is represented by an arrow, and the web guiding roller 5 which rotates in the counterclockwise direction, a free running section 13 is produced, within which the material web 11 only bears against the conveyor belt 9 and does not come into contact with a dry cylinder or a web guiding roller. A scraper 15 which prevents spoiled material winding around the dry cylinder 3 in the event of a tear in the web rests against the surface of the dry cylinder 3. Said scraper also serves to transfer to the web guiding roller 3 a threading strip, which is also referred to as a band and which is cut off from the material web 11 in the edge region of the material web 11 when the paper manufacturing machine starts up. The scraper 15 therefore runs—depending on its function—over the entire width of the dry cylinder or only a partial region which preferably rests on the guide side of the machine. Three nozzle devices 17, 19 and 21 are mounted on the scraper 15 here. The first nozzle device 17 is, viewed in the conveying direction of the material web or of the conveyor belt, the front nozzle device. It comprises a compressed air pipe 23 from which a gas stream 25 emerges. The latter is directed essentially counter to the conveying direction of the conveyor belt 9 and encloses with the surface of the scraper 15 facing the material web 11 an angle $\alpha$ which lies in the region from −10° to 25°, but is preferably in the region from −5° to 15°. A negative angle refers to a direction of the gas stream 25 which runs towards the surface of the scraper 15. The gas stream 25 impacts on the surface of the dry cylinder 3 and, as it were, scrapes the threading strip off if the latter remains stuck to the surface of the dry cylinder.

The following second nozzle device 19 has, in turn, a compressed air pipe 27 from which a gas stream 29 emerges. This gas stream 29 encloses with the surface of the scraper 15 an angle $\beta$ which lies in the region from 116° to 130°, preferably in the region from 116° to 125°. The gas stream 29 which emerges from the compressed air pipe 27 is therefore essentially directed toward the conveying direction of the conveyor belt 9.

The two nozzle devices 17 and 19 are preferably arranged next to one another a very short distance apart and are located in the region of the front edge of the scraper 15 bearing against the dry cylinder 3. If appropriate, the second nozzle device 19 may be dispensed with. Its use depends on the material web properties, in particular also on its moisture and basis weight. Arranged at the opposite edge of the scraper 15 facing away from the dry cylinder 3 is the third nozzle device 21 which in turn comprises a compressed air pipe 31 from which a gas stream 33 emerges. The gas stream 33 therefore runs approximately transversely with respect to the conveying direction of the conveyor belt 9. It strikes approximately tangentially against the surface of the web guiding roller 5 and serves to apply the threading strip against the conveyor belt running on the sucked surface of the web guiding roller 5. The gas stream 33 encloses with the surface of the scraper 15 an angle $\delta$ which may lie in the region from 65° to 130° and which preferably has an angular range of 80° to 125°.

By means of the gas stream 25, directed counter to the conveying direction of the material web 11, of the first nozzle device 17, the threading strip is scraped off the surface of the dry cylinder 3 and applied against the surface of the conveyor belt 9. The second nozzle device 19, which, viewed in the conveying direction of the conveyor belt 9, directly follows the first nozzle device 17, serves to stabilize the threading strip on the surface of the conveyor belt 9. In order to ensure that the threading strip remains on the surface of the web guiding roller 5 and does not pass into the storage area lying below the dry end 1, the threading strip is stabilized on the conveyor belt running on the sucked surface of the web guiding roller 5, with the aid of the third nozzle device 21.

The conveyor belt 9 is of porous design. A partial vacuum acting in the region of the web guiding roller 5 additionally serves to secure the threading strip to the conveyor belt 9 at the wrapping region of the web guiding roller 5. The partial vacuum also serves to stabilize the material web 11 on the surface of the web guiding roller 5 while the paper manufacturing machine is operating.

The nozzle devices 17 to 21 are assigned an actuation device 35 which is connected to the nozzle devices 17, 19 or 21 via lines 37, 39 and 41 indicated by dashed lines. The actuation device 35 can be assigned in each case to a group of nozzle devices assigned to a scraper 15. It is also possible to coordinate, within a dry group, the nozzle devices of a plurality of scrapers by means of a single actuation device 35. Finally, it is conceivable for one actuation device to be assigned to all the nozzle devices of a dry group.

The actuation device 35 can be provided with solenoid valves 43, 45 and 47 assigned to each line 37, 39 and 41, and with air-quantity adjusters 49, 51 and 53 which are provided in the lines 37, 39 and 41 or are integrated into the actuation device 35. Finally, the actuation device 35 also comprises a clocking circuit 55 which makes it possible to generate a pulsating air stream. The clocking circuit 55 is configured in such a way that the clocking frequency can be varied in a range from 0.1 Hz to 5 Hz, preferably from 0.2 Hz to 2 Hz, it being possible to select different proportions of blowing time and pause. Here, there may also be provision for the clocking frequency in the individual nozzle devices to vary.

Figure 2:
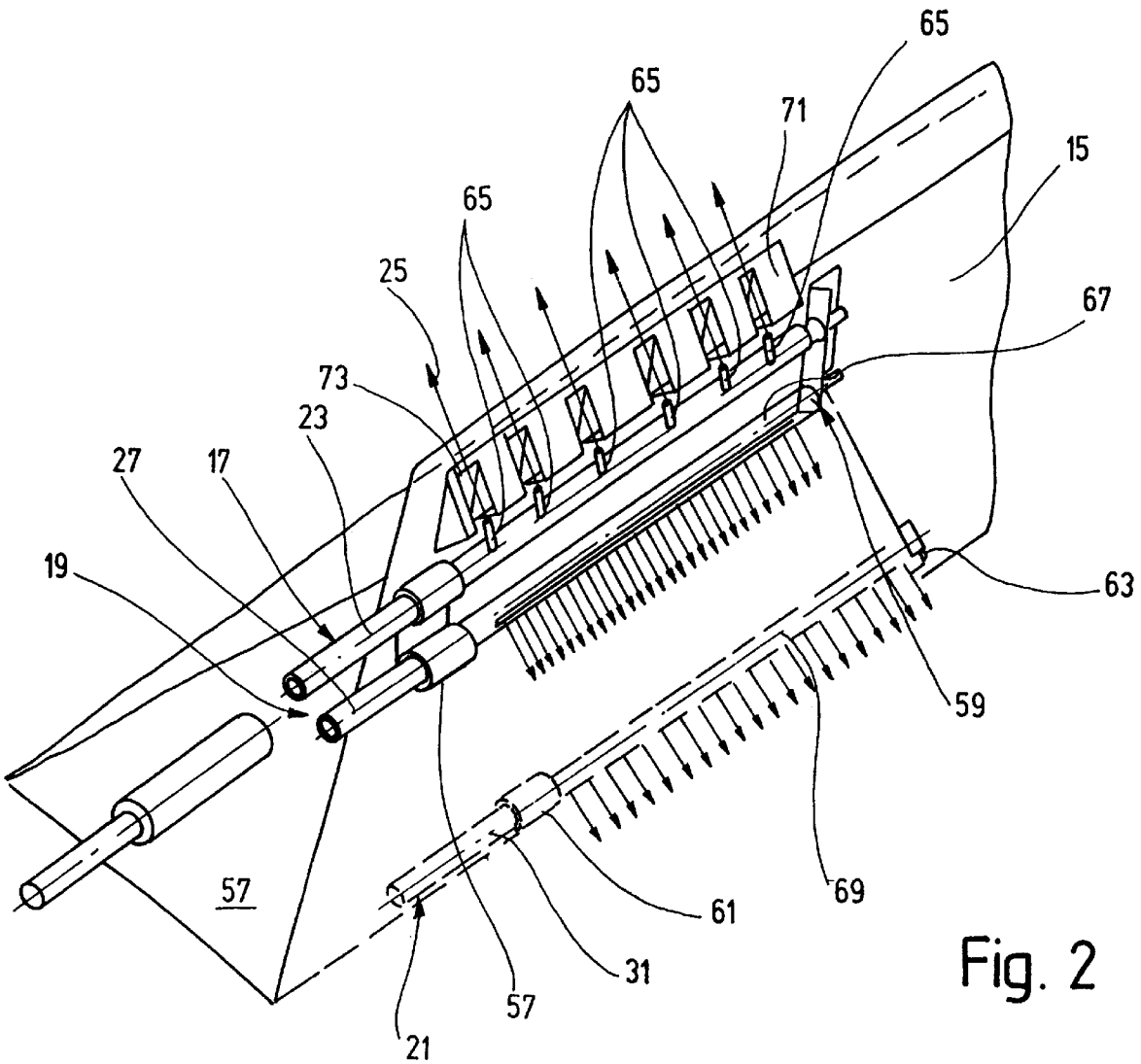
FIG. 2 shows a perspective view of a scraper part of a dry end.

FIG. 2 shows a perspective view of the scraper 15, which is also illustrated in FIG. 1. Identical parts are provided with identical reference numerals, so that in this respect the description of FIG. 1 may be referred to. The scraper 15 extends preferably along the entire width of the paper manufacturing machine. The nozzle devices 17, 19 and 21 are configured in such a way that they are assigned to only one threading strip, which is not illustrated here and which is led through a dry end 1 only during a threading procedure.

The compressed air pipes 23 and 27 are fixed on their side facing the end face of the scraper 15 by means of a clamping device 57 which permits the compressed air pipes 23 and 27 to rotate. At their ends, the compressed air pipes 23 and 27 are mounted in a guide 59.

Correspondingly, a clamping device 61 which interacts with a guide 63 is provided for the compressed air pipe 31 of the third nozzle device 21.

The nozzle devices 17, 19 and 21 may have individual nozzles or slit nozzles. In the exemplary embodiment illustrated here, the first nozzle device 17 has individual nozzles 65 which comprise short compressed air pipe sections which emerge from the compressed air pipe 23 radially. In FIG. 2, it is indicated that the compressed air pipe 27 is provided with slit nozzles 67. In accordance with FIG. 2, the compressed air pipe 31 also has slit nozzles 69.

The individual nozzles 65 are assigned a preferably wedge-shaped cover 71, the tip of which points counter to the direction of movement of the material web and which has cutouts 73 which are each arranged in the region of the individual nozzles 65. The cover 71 serves to prevent waste material from blocking the individual nozzles 65, which is especially possible in particular if the individual nozzles are pivoted into the region of the cutouts 73 and thus are in a very protected position.

The combination, selected here, of individual nozzles and slit nozzles for the compressed air pipes 23, 27 and 31 has proven particularly successful because the directed air or gas stream 25, emerging from the individual nozzles 65 very effectively overcomes the adhesion forces between the material web 11 and the surface of the dry cylinder 3, which forces are particularly high especially in the case of a still relatively damp material web. The slit nozzles 67 and 69 of the compressed air pipes 27 and 31 build up a uniform air curtain which avoids twisting of the threading strip and ensures particularly reliable guidance.

From FIG. 2 it is apparent that the compressed air pipes are mounted in a very simple way so that it is very easy to adjust the gas streams. Furthermore, it is easily possible to reproduce the setting of the compressed air pipes.

By means of the actuation device 35, it is possible to generate a pulsating air stream, which leads to a significant reduction in the air volume necessary for releasing and guiding the threading strip. Nevertheless the short intensive pulses of the gas streams ensure that the threading strip is reliably released from the dry cylinder.

The nozzle devices 17, 19 and 21 avoid a paper jam at the scraper 15 with a high degree of reliability. At the same time, a means of transferring the threading strip from a dry cylinder to a following web guiding roller, which means is very reliable and not susceptible to faults, is obtained.

In order to ensure that the threading strip is reliably transferred, preferably all the dry cylinders of a dry end are provided with a scraper and with nozzle devices, as has been explained with relation to FIGS. 1 and 2. The scrapers can be formed as cleaning scrapers or transfer scrapers, the transfer scrapers being as a rule significantly shorter than the cleaning scrapers. It is also conceivable to combine the nozzle devices with lifting-off scrapers.

The use of various nozzle types in conjunction with the compressed air pipes of the nozzle devices ensures that the threading strip is reliably transferred. The individual nozzles 65 enable the adhesion forces to be reliably overcome. The slit nozzles 67 and 69 of the compressed air pipes of the second and third nozzle devices 19 and 21 permit the threading strip to be reliably transferred.

The actuation device 35 is preferably configured in such a way that the compressed air pipes 65 have compressed air applied to them only in the region of the dry end in which the threading strip is located at a given moment. Nozzle devices which the threading strip has not yet reached therefore remain unpressurized, so that the amount of compressed air required is significantly reduced. A further means of reducing the amount of compressed air required is achieved by virtue of the fact that the actuation device 35 has a clocking circuit 55 which makes a pulsating air stream possible. The transfer of the threading strip is so reliable that an additional cable guiding means or ropes can be dispensed with.

Figure 3:
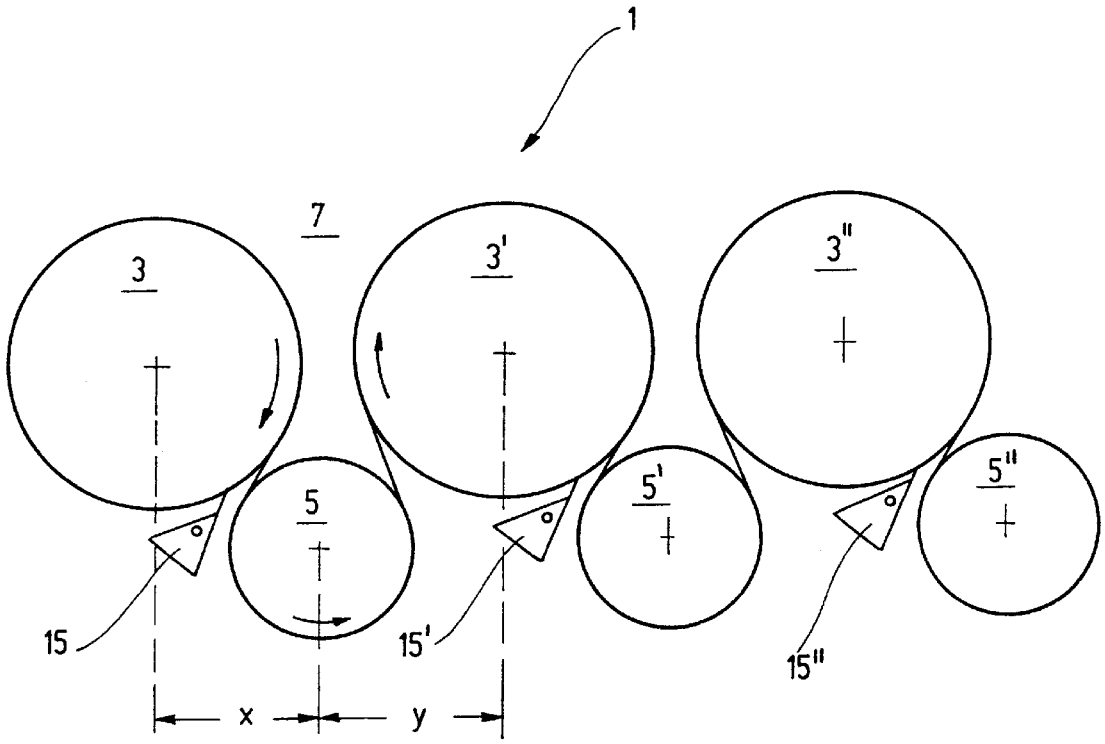
FIG. 3 shows a schematic side view of a plurality of dry cylinders and vacuum-supported web guiding rollers of a dry end.

FIG. 3 shows a plurality of dry cylinders 3, 3' and 3" (arranged one next to the other in a plane) of a dry group 7 which is part of a dry end 1. Web guiding rollers 5, 5' and 5" are arranged, also in a plane, underneath the dry cylinders.

It is clear from FIG. 3 that the distance, measured in the horizontal direction, between the center point of the dry cylinder 3 and the center point of the web guiding roller 5 is designated by x, and the distance between the center point of the web guiding roller 5 and the center point of the following dry cylinder 3' is designated by y. Scrapers 15, 15' and 15" which are structured in the way illustrated in FIGS. 1 and 2 and which have nozzle devices which, for reasons of better clarity, are not represented in FIG. 3, are assigned to the dry cylinders 3, 3' and 3".

The distances x and y are selected as a function of the configuration of the web guiding rollers 5, 5' and 5". Preferably, the distances comply with the inequality $x<y$ if the web guiding rollers are designed as so-called suction rollers. If rollers which are sucked as web guiding rollers are used, the inequality $x \geqq y$ is selected for the distances. Given such a configuration of the dry group 7, particularly reliable means of transferring the threading strip with the aid of the nozzle devices 17, 19 and 21 provided on the scrapers 15 is obtained.

It is therefore apparent that the arrangement of the nozzle devices cannot be considered in isolation, but rather that, in addition, the distances x and y can be optimized in order to ensure that the threading strip is transferred in an optimum way.

From the explanations relating to FIGS. 1 to 3 it becomes clear that in order to ensure a reliable transfer it is necessary for the arrangement of the nozzle devices on a scraper, the alignment of the gas streams flowing out of the nozzle devices and the arrangement of the dry cylinders and web guiding rollers which interact with the scrapers to be selected in an optimum way for the transfer characteristics. The first and second nozzle devices 17 and 19 are arranged one behind the other in the direct vicinity, while the distance to the third nozzle device 21 is significantly greater. Furthermore, the gas streams of the nozzle devices are aligned in accordance with the angular information so that the threading strip is released from the surface of the dry cylinder 3 in an optimum way and it is reliably ensured that the strip is passed onto the conveyor belt running on the sucked surface of the web guiding roller 5. In order to achieve a good scraping off effect, the first nozzle device 17 is provided with individual nozzles 65, while the two other nozzle devices 19 and 21 have slit nozzles in order to ensure reliable guidance of the threading strip. Finally, the spacing conditions between two adjacent dry cylinders with respect to the web guiding roller lying between them are to be selected, as explained in FIG. 3, in such a way that reliable transfer of the threading strip is ensured.

Below, details will be given on the method of transferring a threading strip within a dry end which serves to dry a material web, in particular a paper or cardboard web. It is known that an edge strip, which is also referred to as band or threading strip, is cut off from a material web during a threading procedure, for example by means of a sharp cutter. This threading strip is guided through the dry end, preferably at full working speed of the machine, in order to manufacture a material web. The threading strip runs here in a winding path around the dry cylinders and web guiding rollers of the dry end, during which it is guided in the region of the dry cylinders between the conveyor belt and the surface of the dry cylinders and in the region of the web guiding rollers runs freely on their surface. The transfer from a dry cylinder to a following web guiding roller is problematic, since the threading strip remains stuck on the surface of the dry cylinder owing to adhesion forces. It must therefore be released from this surface and guided onto the conveyor belt. The threading strip must then be led onto the web guiding roller with the conveyor belt and run around said roller. The removal of the threading strip from the surface of the dry cylinder and the transfer to the conveyor belt and to the surface of the web guiding roller is effected in the method according to the invention with the aid of at least two/one, preferably three, gas streams which serve, on the one hand, to scrape off the threading strip by overcoming the adhesion forces of the surface of the dry cylinder and, on the other hand, to place said threading strip against the surface of the conveyor belt and keep it on the surface of the following web guiding roller. The adhesion forces are overcome by means of a first gas stream which is directed essentially counter to the conveying direction of the material web or of the threading strip. This effect can be optimized by virtue of the fact that the direction of the gas stream can be adjusted. It has become apparent that, in order to scrape the threading strip from the surface of the dry cylinder, the gas stream should enclose an angle of from −10° to 25° with that surface of a scraper on which the nozzle device emitting the gas stream is fixed. An angle $\alpha$ of from −5° to approximately 15° has proven particularly successful. The selected angle $\alpha$ depends on the material properties and the moisture content of the threading strip.

The threading strip can have a second gas stream applied to it, which acts on the threading strip directly after the first gas stream and runs essentially transversely with respect to the conveying direction of said strip. This gas stream ensures that the threading strip which is scraped off from the dry cylinder and transferred to the conveyor belt remains reliably on the conveyor belt and is applied to the surface of the web guiding roller.

The angle of the second gas stream can in turn be adapted to the material properties and the moisture content of the threading strip. It can be in the region from 116° to 130°. An angle $\beta$ between 116° and 125° has proven particularly successful.

At a distance from the two gas streams, there is finally a possible third stream acting, which serves in particular to keep the threading strip reliably on the web guiding roller and to stabilize it there. It is aligned in such a way that the threading strip can be guided around the web guiding roller and arrives at the following dry cylinder. The angle of the third gas stream is in turn adjustable so that material properties and moisture content of the threading strip can be taken into account. The angle $\delta$ of the third gas stream can be from 65° to 130°. A nozzle device which emits a gas stream which encloses an angle $\delta$ from 80° to 125° with the surface of the scraper on which the nozzle device is mounted has proven particularly successful.

Since the transfer of the threading strip preferably takes place at full working speed, in a range from 500 m/min to 2400 m/min, considerable amounts of gas or air are required in order to generate the aforementioned gas streams, especially since the gas streams are preferably generated at all the transfer regions between a dry cylinder and a following web guiding roller. In order to reduce the gas requirement, in the method used here the gas streams are controlled in such a way that they are activated and deactivated with staggered timing within a dry end. In particular, the gas streams are activated only where the start of the threading strip is located within the dry end, that is to say regions which the start of the threading strip has not yet reached or which it has already passed through do not have gas streams applied to them so that the gas or air requirement is reduced.

A further reduction in the air requirement is possible by virtue of the fact that with the method used here the gas streams are generated by means of a clocked air stream, it being possible for the clocking frequency to lie in the range from 0.1 Hz to 5 Hz. A clocking frequency of 0.2 Hz to 2 Hz has proven particularly successful, it being possible to select different proportions of blowing time to pause.

In order to ensure that the threading strip is reliably released from the dry cylinder, dot-shaped partial streams, which are generated with the aid of individual nozzles, are preferred for the first gas stream which counteracts the conveying direction of the threading strip. These flows permit the adhesion forces to be overcome particularly reliably. Over the further course of the threading strip its reliable guidance is of great importance. For this reason, planar partial flows, which are generated with the aid of slit nozzles, are used for the second and third gas streams. The planar application of gas streams to the threading strip leads to a reliable and low-flutter guidance of the threading strip. In particular, the threading strip is prevented from becoming twisted in the region of the gas streams, which can lead to a paper jam and tearing off of the threading strip.

The specific distribution of the gas streams described here leads to a particularly reliable transfer of the threading strip: since two directly adjacent gas streams are firstly applied to said strip, it is possible to ensure reliable release and transfer of the threading strip to the conveyor belt and to the surface of the web guiding roller. At a distance from the two first gas streams, the third gas stream then acts, said third gas stream ensuring the threading strip follows the surface of the web guiding roller and is deflected to the next dry cylinder. Since the threading strip has gas streams applied to it virtually over half the wrapping region of the web guiding roller, it is possible to ensure that the threading strip is transferred with little disruption.

We claim:

1. A dry end of a machine for drying a material web, the dry end having at least one dry group comprised of a series of dry cylinders alternating with web guide rolls, wherein the web alternately wraps one side of a dry cylinder and leaves the dry cylinder to wrap the opposite side of the next adjacent web guide roll and then successively travels to and wraps over successive ones of the dry cylinders and the web guide rolls;

a conveyor belt for the web passing through the dry group in a winding path first over the one side of a dry cylinder and then over the opposite side of the next adjacent guide roll in the web path and successively over the dry cylinder and the guide rolls, wherein an open path of the conveying belt and the web is defined between one of the dry cylinders and the following adjacent guide roll and wherein the web wraps over the one side of the one dry roll while the web is sandwiched between the surface of the one dry roll and the conveyor belt and the web then passes around the outside of the conveyor belt as the web and the belt wrap around the opposite side of the next adjacent guide roll;

at least first and second nozzle devices extending across the width of the web and being arranged one after each other along the open path of the conveyor belt and the web from the one dry cylinder to the adjacent guide roll and the nozzles being at the side of the belt at which the web passes across the open path along with the belt;

the first nozzle device including individual nozzles in an array across the width of the web directed to blow air toward the dry cylinder and the belt for lifting a threading strip of the web off the dry cylinder and toward the conveyor belt in the open path;

the second nozzle device generating air that moves against the web to help stabilize the web on the belt.

2. The dry end of claim 1, wherein the second nozzle device comprises an elongate slit nozzle elongated across the width of the web.

3. The dry end of claim 1, wherein the second nozzle device is oriented to generate a gas stream which runs essentially in the conveying direction of the material web from the dry cylinder to the guide roll.

4. The dry end of claim 1, further comprising a third nozzle device for generating a gas stream and oriented for generating the gas stream to run essentially transverse to the conveying direction of the material web, and the third nozzle device being located for directing the gas stream at the web after the web has begun running wrapped on the conveying belt around the opposite side of the guide roller.

5. The dry end of claim 1, further comprising a scraper including a scraper element for scraping the dry cylinder at a point after the conveyor belt separates from the one dry cylinder on the path to the one guide roll, and the first and second nozzle devices being mounted on the scraper.

6. The dry end of claim 5, further comprising the scraper being shaped for defining individual cut outs for the individual ones of the nozzles of the first nozzle device for providing protection for the nozzles and permitting exit of the gas stream therefrom.

7. The dry end of claim 1, wherein the first nozzle device is directed to generate a gas stream in the direction essentially counter to the conveying direction of the material web from the dry cylinder toward the guide roll.

8. The dry end of claim 7, further comprising a scraper including a scraper element for scraping the one dry cylinder at a point after the conveyor belt separates from the one dry cylinder on the path to the one guide roll, and the first and second nozzle devices being mounted on the scraper;

the first nozzles are oriented to direct a gas stream at an angle $\alpha$ with respect to that surface of the scraper that faces the material web which angle lies in the region of $-10° \leqq \alpha \leqq 25°$.

9. The dry end of claim 8, wherein the angle is in the range of $-5° \leqq \alpha \leqq 15°$.

10. The dry end of claim 7, wherein the second nozzle device is oriented to generate a gas stream which runs essentially in the conveying direction of the material web from the dry cylinder to the guide roll.

11. The dry end of claim 10, further comprising a scraper including a scraper element for scraping the one dry cylinder at a point after the conveyor belt separates from the one dry cylinder on the path to the one guide roll, and the first and second nozzle devices being mounted on the scraper;

the second nozzle device directing a gas stream to run at an angle $\beta$ with respect to the surface of the scraper that is facing the material web, which angle lies in the region of $116° \leqq \beta \leqq 130°$.

12. The dry end of claim 11, wherein the angle is in the range of $116° \leqq \beta \leqq 125°$.

13. The dry end of claim 10, further comprising a third nozzle device for generating a gas stream and oriented for generating the gas stream to run essentially transverse to the conveying direction of the material web, and the third nozzle device being located for directing the gas stream at the web after the web has begun running wrapped on the conveying belt around the opposite side of the guide roller.

14. The dry end of claim 13, further comprising a scraper including a scraper element for scraping the one dry cylinder at a point after the conveyor belt separates from the one dry cylinder on the path to the one guide roll, and the first, second and third nozzle devices being mounted on the scraper;

the third nozzle device being oriented and aimed so that the gas stream generated thereby runs at an angle $\delta$ with respect to that surface of the scraper that faces the material web which angle lies in the region where $65° \leqq \delta \leqq 130°$.

15. The dry end of claim 14, wherein the angle is $80° \leqq \delta \leqq 125°$.

16. The dry end of claim 13, further comprising a scraper including a scraper element for scraping the one dry cylinder at a point after the conveyor belt separates from the one dry cylinder on the path to the one guide roll, and the first, second and third nozzle devices being mounted on the scraper;

the scraper having a front edge at the one dry cylinder and the first nozzle device being arranged near the front edge of the scraper.

17. The dry end of claim 16, wherein the first and second nozzle devices are arranged one after the other at a small interval spacing with reference to the open path of the conveyor belt from the one dry cylinder to the one guide roll.

18. The dry end of claim 17, wherein the scraper has a rear edge at the opposite edge thereof from the front edge at the one dry roll, and the third nozzle device is arranged near the rear edge of the scraper.

19. The dry end of claim 18, wherein the third nozzle device is spaced at a substantially greater distance from the second nozzle device than the distance of spacing between the first and second nozzle devices.

20. The dry end of claim 13, wherein at least the second and third nozzle devices have slit extending across the width of the web nozzles.

21. The dry end of claim 13, wherein of the first, second and third nozzle devices, at least one has individual pipe nozzles extending in an array across the width of the web and at least one has a slit nozzle extending across the width of the web.

22. The dry end of claim 13, wherein the third nozzle device comprises a slit nozzle extending across the width of the web.

23. The dry end of claim 13, further comprising a scraper including a scraper element for scraping the one dry cylinder at a point after the conveyor belt separates from the one dry cylinder on the path to the one guide roll, and the first, second and third nozzle devices being mounted on the scraper;

the scraper being at least one of a roll cleaning, threading strip of the web lifting, and web transferring scraper.

24. The dry end of claim 13, where all of the nozzle devices include a compressed air supply pipe for the supply of compressed air to each of the nozzle devices.

25. The dry end of claim 1, further comprising individual cut out arrangements at the individual nozzles of the first nozzle device for shielding the individual nozzles.

26. The dry end of claim 1, further comprising a plurality of the dry cylinders alternating with the guide rolls;

a respective scraper at each of the dry cylinders, each scraper including a scraper element for scraping the respective dry cylinder at a point after the conveyor belt separates from the dry cylinder on the path to the adjacent guide roll, and a respective one of the first and of the second nozzle devices being mounted on each scraper.

27. The dry end of claim 26, where all of the nozzle devices include a compressed air supply pipe for the supply of compressed air to each of the nozzle devices;

an actuating device connected with the nozzle devices for selectively operating the nozzle devices at each of the dry cylinders.

28. The dry end of claim 27, wherein a respective one of the actuating devices is assigned to individual ones of the nozzle devices of the dry end.

29. The dry end of claim 28, wherein each of the actuating devices includes a solenoid valve for operating the respective nozzle device.

30. The dry end of claim 28, further comprising each of the actuating devices including a respective air quantity adjustment device assigned to and connected with each of the nozzle devices.

31. The dry end of claim 28, further comprising a clocking circuit connected to the actuating device for generating a pulsating air stream.

32. The dry end of claim 28, further comprising a clocking circuit for selectively controlling the actuating device to deliver air stream to each of the nozzle devices at one of the cylinders at a time related to the passage of the threading strip of the web past the respective dry cylinder.

33. The dry end of claim 26, wherein one of the web guide rolls is a suction roll, and the distance between the one dry cylinder and the subsequent one web guide roll that is a suction roll is smaller than the distance between the one web guide roll and the subsequent dry cylinder.

34. The dry end of claim 26, wherein one of the web guide rolls is a sucked roll; and the distance between the one dry cylinder and the subsequent one web guide roll which is a sucked roll is at least equal to the distance between the one guide roll and the next in sequence dry cylinder.

35. A method for transferring a threading strip of a material web within a dry end of a machine which dries the web, wherein the dry end includes at least one dry cylinder and a web guide roll that follows the dry cylinder along a path of the web with a space between the one dry cylinder and the web guide roll, and includes a web conveying belt which passes from the one dry cylinder to the following web guide roll and the belt is intended to carry the web on one side of the belt, wherein the web is sandwiched between the belt and one side of the dry cylinder and wherein the web passes around the outside of the conveyor belt as the conveyor belt wraps the opposite side of the following web guide roll, the method comprising running a web having a leading threading strip over the one dry cylinder and under the conveyor belt, running the web along with the conveyor belt from the one dry cylinder toward the following web guide roll and running the web with the leading threading strip around the web guide roll;

directing first and second successive gas streams to the web as and after it leaves the one dry cylinder on the path to the following web guide roll for removing the threading strip from the one dry cylinder and for holding the web against the conveyor belt.

36. The method of claim 35, wherein the second gas stream which follows the first gas stream is directed essentially along the conveying direction of the material web from the one dry cylinder to the following guiding roll.

37. The method of claim 35, wherein the first gas stream is directed essentially counter to the conveying direction of the material web from the one dry cylinder to the following guide roller.

38. The method of claim 37, wherein the second gas stream which follows the first gas stream is directed essentially along the conveying direction of the material web from the one dry cylinder to the following guiding roll.

39. The method of claim 38, further comprising directing a third gas stream toward the material web after the first and second gas streams in the path of the web from the one dry cylinder and directing the third stream essentially transversely with respect to the conveying direction of the web against the web as the web wraps the following guiding roll.

40. The method of claim 39, further comprising activating the first, second and third gas streams in staggered timing.

41. The method of claim 40, further comprising activating the gas stream along the path of the web between the one dry cylinder and the following guiding roll only when the threading strip for the web is passing.

42. The method of claim 41, further comprising generating the gas streams by providing each as a clocked air stream.

43. The method of claim 42, wherein the clocking frequency of the clocked air stream is in the range of 0.1 Hz to 5 Hz.

44. The method of claim 43, wherein the clocking frequency of the clocked air stream is in the range of 0.2 Hz to 2 Hz.

* * * * *